United States Patent [19]

Hirahara et al.

[11] Patent Number: 4,814,820

[45] Date of Patent: Mar. 21, 1989

[54] ELECTROSTATIC LATENT IMAGE DEVELOPING APPARATUS

[75] Inventors: Hideaki Hirahara, Sagamihara; Tatsuo Takabe, Mitaka; Kazuya Ishida, Sagamihara; Hiromitsu Saijo, Toyokawa; Shinya Matsuda, Toyokawa; Masaru Komura, Toyokawa, all of Japan

[73] Assignee: Minolta Camera Kabushiki Kaisha, Osaka, Japan

[21] Appl. No.: 193,122

[22] Filed: May 6, 1988

Related U.S. Application Data

[63] Continuation of Ser. No. 875,671, Jun. 18, 1961, abandoned.

[30] Foreign Application Priority Data

| | | | |
|---|---|---|---|
| Jun. 29, 1985 | [JP] | Japan | 60-143337 |
| Jul. 9, 1985 | [JP] | Japan | 60-153116 |
| Oct. 1, 1985 | [JP] | Japan | 60-219917 |

[51] Int. Cl.[4] ..... G03G 15/09

[52] U.S. Cl. ..... 355/300; 118/657

[58] Field of Search ..... 355/3 R, 30 D, 14 D; 118/653, 657, 658, 661

[56] References Cited

U.S. PATENT DOCUMENTS

| | | | |
|---|---|---|---|
| 3,939,801 | 2/1976 | Tanaka et al. | 355/3 DD X |
| 3,988,816 | 11/1976 | Tada | 29/116 R |
| 4,030,447 | 6/1977 | Takahashi et al. | 355/3 X |
| 4,365,586 | 12/1982 | Hosono et al. | 118/652 |
| 4,392,735 | 7/1983 | Oka | 355/3 DD |
| 4,425,373 | 1/1984 | Hosono et al. | 118/657 X |
| 4,430,957 | 2/1984 | Cherbu et al. | 118/657 |
| 4,468,111 | 8/1984 | Yamagata et al. | 355/3 DD |
| 4,492,456 | 1/1985 | Haneda et al. | 355/3 DD |
| 4,511,239 | 4/1985 | Kanbe et al, | 355/3 DD |
| 4,525,056 | 6/1985 | Itaya et al. | 355/3 DD |
| 4,575,218 | 3/1986 | Sakamoto et al. | 355/3 DD |
| 4,577,587 | 3/1986 | Kamezaki et al. | 118/658 |
| 4,607,933 | 8/1986 | Haneda et al. | 355/3 DD |
| 4,638,760 | 1/1987 | Nakamura et al. | 355/3 DD X |

FOREIGN PATENT DOCUMENTS

| | | |
|---|---|---|
| 54-25325 | 3/1979 | Japan . |
| 54-30837 | 7/1979 | Japan . |
| 56-47552 | 10/1981 | Japan . |
| 59-52267 | 3/1984 | Japan . |
| 59-28431 | 8/1984 | Japan . |

*Primary Examiner*—Fred L. Braun

*Attorney, Agent, or Firm*—Burns, Doane, Swecker & Mathis

[57] ABSTRACT

An electrostatic latent image developing apparatus has a developing sleeve, an agitating roller rotatable in the same direction as the developing sleeve and a magnetic device fixedly provided within the developing sleeve and having a plurality of N and S poles which include auxiliary poles of the same polarity adjacent to each other circumferentially of the sleeve and opposed to the agitating roller. A developer restraining plate between the developing sleeve and the agitating roller has a first guide surface for guiding the developer supplied by the agitating roller and a second guide surface for limiting the developer used from moving toward the sleeve portion to which the developer is supplied by the agitating roller.

10 Claims, 4 Drawing Sheets

ELECTROSTATIC LATENT IMAGE DEVELOPING APPARATUS

This application is a continuation, of application Ser. No. 06/875,671, filed June 18, 1986, now abandoned.

BACKGROUND OF THE INVENTION

1. Field of the Invention

The present invention relates to a developing apparatus for use in the electrophotographic copying process or the like to convert to visible images electrostatic latent images formed on an electrostatic latent image bearing member.

2. Description of the Prior Art

Developing apparatus have heretofore been provided which comprise a developing sleeve made of aluminum or the like and having a magnet fixedly provided therein, and a drivingly rotatable developer agitating roller (such as a bucket roller or screw roller) for supplying a developer to the outer periphery of the sleeve. The developing sleeve is adapted to support the developer thereon and to transport the developer to a developing station opposed to an electrostatic latent image bearing member, whereby an electrostatic latent image formed on the surface of the bearing member is developed to a visible image.

Generally with developing apparatus, the developer passing through the developing station and used for development has a reduced toner concentration, so that the developer needs to be temporarily removed from the outer periphery of the developing sleeve and, so to speak, replaced by a fresh portion of developer supplied to the sleeve peripheral surface.

Accordingly, it is conventional practice to provide a scraper in pressing contact with the outer periphery of the developing sleeve at a location downstream from the developing station for scraping off the developer used as disclosed in U.S. Pat. No. 4,054,230.

The outer peripheral surface of many developing sleeves has minute projections or identations formed as by sandblasting to transport the developer with improved efficiency. When the scraper is held in pressing contact with the sleeve surface in this case, the scraper wears the developing sleeve markedly and causes the developer to clog up the minute indentations by the pressing contact. The accumulation of developer solidifies with time, no longer permitting the sleeve surface to support the developer as uniformly distributed thereover.

The conventional apparatus has another problem in that the scraper, when provided, imposes a limitation on the position where the agitating roller and the like are to be installed, rendering the apparatus large-sized.

SUMMARY OF THE INVENTION

The main object of the present invention is to provide an electrostatic latent image developing apparatus free of the above drawbacks and capable of producing distinct copy images without irregularities or reduction in density.

Another object of the present invention is to provide an electrostatic latent image developing apparatus wherein the developer used for development is removable from the surface of the developing sleeve, and a fresh portion of developer can be supplied to the sleeve surface.

Another object of the present invention is to provide an electrostatic latent image developing apparatus wherein the developer used for development can be removed from the surface of the developing sleeve without using a scraper or like device.

These and other objects of the present invention are accomplished by providing an electrostatic latent image developing apparatus which comprises:

(1) a developing sleeve drivingly rotatable for supplying a developer to the surface of an electrostatic latent image bearing member, (2) an agitating roller for supplying the developer to the developing sleeve while mixing and agitating the developer, the agitating roller being rotatable in the same direction as the developing sleeve to move in a direction opposite to the movement of the sleeve at the portion thereof adjacent to the sleeve, the center of rotation of the agitating roller being positioned approximately on the same horizontal plane as the center of rotation of the sleeve, and (3) magnetic means fixedly provided within the developing sleeve and having a plurality of N and S poles extending axially of the sleeve, the N and S poles including auxiliary poles of the same polarity adjacent to each other circumferentially of the sleeve and opposed to the agitating roller in the vicinity of the horizontal plane through the center of rotation of the sleeve, the auxiliary poles being disposed at the upstream side of the sleeve portion to which the developer is supplied by the agitating roller.

These and other objects, advantages and features of the invention will become apparent from the following description taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

The present invention will be described first with reference to the drawings showing embodiments thereof.

Figure 1:
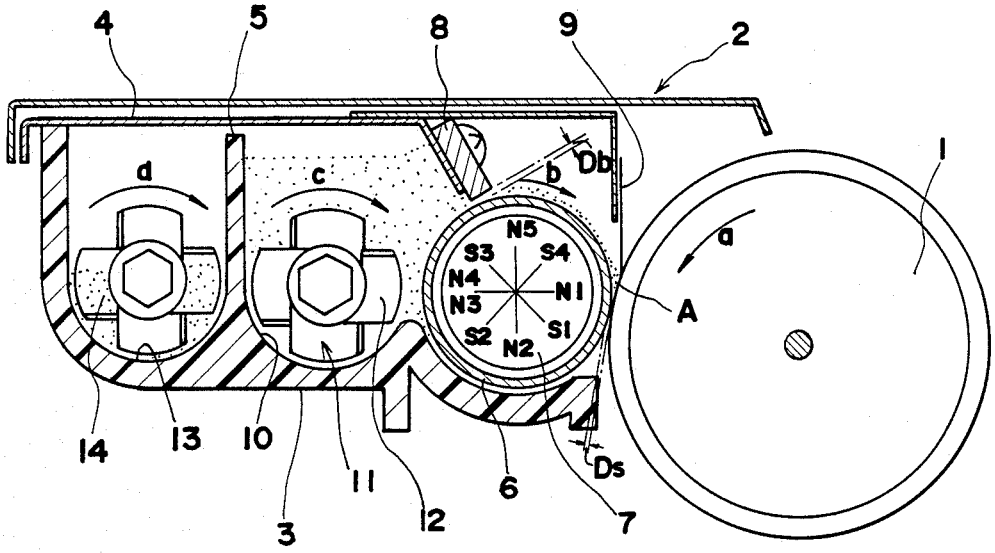
FIG. 1 is a sectional view showing an embodiment of the developing apparatus of the present invention.

FIG. 1 shows a photosensitive drum 1 and a developing apparatus 2 embodying the invention. The developing apparatus 2 comprises a developing sleeve 6, an agitating roller 11 and a supply roller 14 which are housed in a casing composed of a developer container 3 and a cover 4 and which are arranged one after another rearwardly away from the drum 1.

The drum 1 is in the form of a hollow cylinder having an organic photosensitive surface layer and is drivingly rotatable in the direction of arrow a. When light is projected on the drum surface from an unillustrated optical system, an electrostatic latent image is formed on the surface.

The developing sleeve 6 is in the form of a hollow cylinder made of an electrically conductive non-magnetic material (such as aluminum). Approximately 5 to 10 μm minute indentations are formed in the outer peripheral surface of the sleeve 6 by sandblasting. The sleeve 6 is rotatable relative to the drum 1 and is drivingly rotatable in the direction of arrow b for development. The developing sleeve 6 is opposed to the drum 1 with a developing gas Ds formed therebetween.

The developing sleeve 6 has in its interior a magnetic roller 7 provided with magnetic poles along its outer periphery. A developer (usually comprising a mixture of carrier and toner) is supported on the outer periphery of the sleeve 6 by the magnetic force of the roller 7 and is transported to a developing station A opposed to the drum 1. The electrostatic latent image formed on the drum 1 is developed with the developer transported to the station A.

The magnetic roller 7 is fixedly provided within the developing sleeve 6. Poles N1 to N5 and poles S1 to S4 are arranged generally alternately along the roller outer periphery. These poles include auxiliary poles N3 and N4 of the same polarity which are magnetized to a lesser extent than the other poles and which are positioned adjacent to each other circumferentially of the roller 7 in one side portion thereof opposite to the developing station A and most proximate to the agitating roller 11.

Consequently, a repellent magnetic field X (see FIG. 2) is set up on the surface portion of the sleeve 6 where the auxiliary poles N3 and N4 are located.

The agitating roller 11 is a screw roller which comprises an agitating member having blades 12 and mounted on a shaft. The roller 11 is rotatably provided in a developer agitation-transport channel (hereinafter referred to as an "agitation channel") 10. During development, the agitating roller 11 is driven in the direction of arrow c in timed relation with the developing sleeve 6 to transport the developer within the agitation channel 10 toward the remote end thereof (away from the plane of FIG. 1) and supply the developer to the surface of the sleeve 6 while mixing and agitating the developer with the blades 12.

The supply roller 14 is a screw roller provided in a developer supply-transport channel 13 (hereinafter referred to as a "supply channel") which is defined by a partition wall 5 disposed in the rear of the agitating roller 11. The supply roller 14 is drivingly rotatable in the direction of arrow d to transport the developer within the supply channel 13 toward the near end thereof (closer to the plane of FIG. 1) while mixing and agitating the developer with a supply of toner from an unillustrated toner replenishing container.

The partition wall 5 has a passage at each of its near and remote ends (with respect to the plane of FIG. 1) for holding the agitation channel 10 and the supply channel 13 in communication with each other. The developer transported through the agitation channel 10 to its remote end by the agitating roller 11 is transferred to the supply channel 13 through the passage, then transported through the channel 13 to its near end by the supply roller 14 and sent into the agitation channel 10 again through the other passage.

The cover 4 is provided with a bristle height restricting plate 8 and a toner confining sheet 9. The restricting plate 8 is opposed to the developing sleeve 6 as spaced therefrom by a bristle height restricting gap Db. The plate 8 regulates the amount of developer to be transported by cutting off the ends of bristles of the developer being transported by the sleeve 6.

The toner confining sheet 9 is made of a polyester film (0.1 mm in thickness), such as "Mylar," and adapted to prevent the toner released from around the developing sleeve 6 from scattering upward.

In the developing apparatus 2 having the above construction, the developer is mixed and agitated while being transported in circulation through the agitation channel 10 and the supply channel 13 by the agitating roller 11 and the supply roller 14 and also while being replenished with toner from the unillustrated toner container. Consequently, the toner is fed, as charged to a higher potential, to the surface of the developing sleeve 6.

Figure 2:
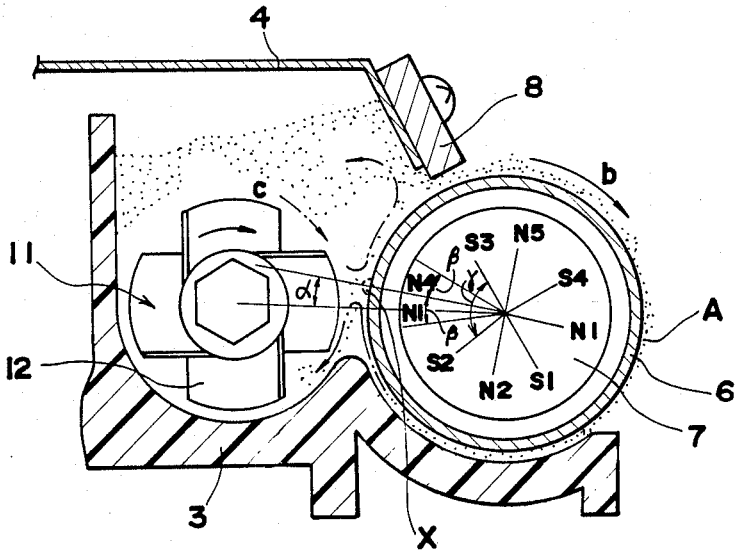
FIG. 2 is a fragmentary sectional view showing the embodiment of FIG. 1.

The developer is supplied to the developing sleeve 6 and delivered therefrom in the manner to be described below with reference to FIG. 2.

The developer remaining on the sleeve surface and having its toner content reduced by passing through the developing station A is transported upward from below on the rear side of the sleeve 6 opposite to the station A and removed from the sleeve surface by the repellent magnetic field X due to the auxiliary poles N3 and N4.

The developer removed from the sleeve 6 is forced toward the agitating roller 11 upon colliding with the portion of developer sent forward by the roller 11 and mixed with the developer in the agitation channel 10 by the agitating roller 11.

On the other hand, the portion of developer forwarded by the blades 12 of the agitating roller 11 collides with the developer repellently removed from the sleeve 6 in the vicinity of the auxiliary poles N3 and N4 of the magnetic roller 7, whereupon the developer portion flows reversely in the direction of transport of the developer along the sleeve 6. As a result, the developer portion is partially transported in the direction (arrow b) of rotation of the sleeve 6 as retained on the sleeve surface and used for development. The remaining quantity of the developer portion not retained in the sleeve 6 turns about in the rear of the bristle height restricting plate 8 to flow back toward the agitating roller 11.

The following experiments were conducted under the conditions give below in detail.

[Experiment 1]

(i) Photosensitive drum
Outside diameter: 50 mm
Peripheral speed: 85 mm/sec
(ii) Developing sleeve
Outside diameter: 24.5 mm
Minute indentations: 10–20 μm
Peripheral speed: 148 mm/sec
Number of revolutions: 115 r.p.m.
(iii) Developing gap Ds: 0.55 mm
(iv) Bristle height restricting gap Db: 0.45 mm
(v) Agitating roller
Outside diameter of blade assembly: 20 mm Peripheral speed: 178 mm/sec
Number of revolutions: 170 r.p.m.
(vi) Magnetic roller
Magnetic force of developing pole N1: 950 G
Magnetic force of poles N2, N5, S1–S4: 600 G
Magnetic force of auxiliary poles N3, N4: up to 50 G
Position of middle point between auxiliary poles N3, N4: +5 deg (see FIG. 2) (The position is expressed in angle $\alpha$ of deflection of the middle point from a line through the centers of the magnetic roller 7 and the agitating roller 11 about the center of the roller 7. "Plus" indicates a downstream deflection.)
Region $\beta$ of auxiliary poles N3, N4: 10 deg
Angle $\gamma$ between poles S2, S3 at the center of magnetic roller: 100 deg
(vii) Distance between sleeve 6 and roller 7: 3–5 mm
(viii) Particle size of carrier: 60 $\mu$m (ferrite-binder type)
(xi) Particle size of toner: 12 $\mu$m An observation window of transparent acrylic resin plate was provided at the longitudinal central portion of the developing apparatus 2 for observing the interior of the developing apparatus therethrough. When the flow of the developer in the apparatus was observed while operating the apparatus under the foregoing conditions, it was found that the developer on the surface of the developing sleeve 6 was completely removed from the surface by the repellent magnetic field X, forced toward the agitating roller 11 and completely replaced by a fresh portion of developer supplied to the sleeve surface by the agitating roller 11 and supported thereon.

[Experiment 2]

(i) Photosensitive drum
Outside diameter: 50 mm
Peripheral speed: 70 mm/sec
(ii) Developing sleeve
Outside diameter: 24.5 mm
Minute indentations: 5–10 $\mu$m
Peripheral speed: 141 mm/sec
Number of revolutions: 110 r.p.m.
(iii) Developing gap Ds: 0.45 mm
(iv) Bristle height restricting gap Db: 0.4 mm
(v) Agitating roller
Outside diameter of blade assembly: 30 mm
Peripheral speed: 141 mm/sec
Number of revolutions: 90 r.p.m.
(vi) Magnetic roller
Magnetic force of developing pole N1: 950 G
Magnetic force of poles N2, N5, S1–S4: 600 G
Magnetic force of auxiliary poles N3, N4: up to 150 G
Position $\alpha$ of middle point between auxiliary poles N3, N4: 0 deg (see FIG. 1)
Region $\beta$ of auxiliary poles N3, N4: 10 deg
Angle $\gamma$ between poles S2, S3: at least 90 deg
(vii) Distance between sleeve 6 and roller 7: 3–5 mm
(vii) Particle size of carrier and toner: same as in Experiment 1

The developer on the developing sleeve 6 was completely replaceable as in Experiment 1, affording satisfactory copy images.

The above and various other experiments conducted revealed the following.

(1) When the middle point between the auxiliary pole N3, N4 is shifted upstream or downstream from the line through the centers of the magnetic roller 7 and the agitating roller 11, with each of these poles given a region of magnetization, $\beta$, of 10 deg, uniform copy images can be obtained without irregularities or a reduction in density if the angle $\alpha$ is 0 to plus 5 deg.
(2) Satisfactory copy images are available when the region of magnetization, $\beta$, is about 10 deg.
(3) The developer is transported downstream over the auxiliary poles N3, N4 when these poles have an excessively great magnetic force.

Preferably, the magnetic force of the auxiliary poles N3, N4 is up to 150 G. When it is up to 50 G, especially good copy images are availble free of irregularities or reduction in density.

(4) When the agitating roller is driven at varying peripheral speeds ranging from 1.0 to 1.5 times the peripheral speed of the developing sleeve, no irregularities occur in density. However, the best copy images are available when the speed of the roller is about 1.1 times the latter speed.
(5) Satisfactory copy images are availble when the gap between the developing sleeve 6 and the agitating roller 11 is 3 to 5 mm.

On the other hand, it is desired that the auxiliary poles be positioned below a horizontal plane through the axis of the developing sleeve when there is a space above and below the region of magnetization of the auxiliary poles of the magnetic roller, i.e., when the developer container is not filled with the developer to the level of this region since the developing apparatus is designed to contain a lesser amount of developer. Such a modification will be described with reference to FIGS. 3 to 5.

Figure 3:
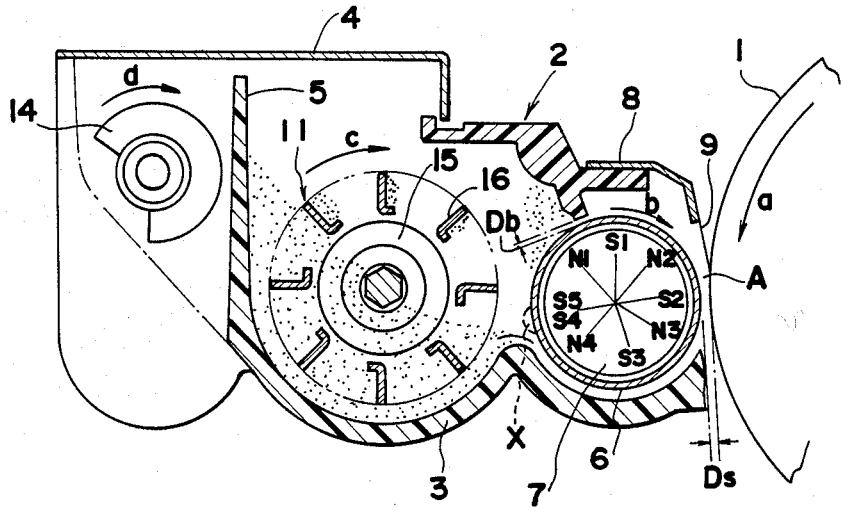
FIG. 3 is a sectional view showing a modification of the embodiment of FIG. 1.

FIG. 3 is a sectional view showing a modified developing apparatus embodying the present invention. This apparatus is generally similar in construction to the apparatus shown in FIG. 1. While the agitating roller 11 in FIG. 1 is a screw roller, the corresponding roller 11 of the modification is a bucket roller comprising a screw 15 and buckets 16 equidistantly arranged around the screw. The bucket roller 11 is drivingly rotatable in the direction of arrow c. With the developing apparatus, therefore, the developer is transported by the screw 15 from near end to remote end along with a fresh portion of toner supplied by the supply roller 14 while being mixed and agitated by the screw 15 and the buckets 16, by virtue of the rotation of the bucket roller 11 in the direction of arrow c. The developer is partially supplied to the surface of the developing sleeve 6 from above.

Figure 4:
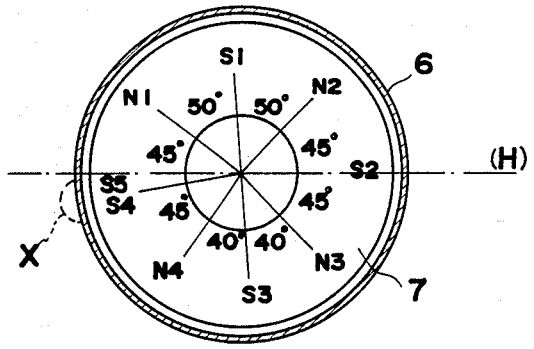
FIG. 4 is a fragmentary sectional view showing the modification of FIG. 3.
Figure 5:
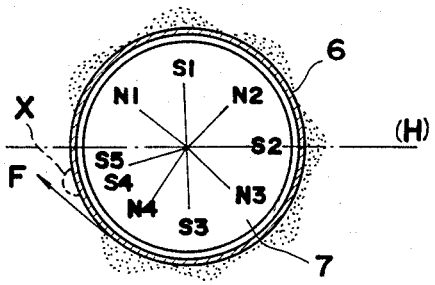
FIG. 5 is a diagram showing a developer as supported on the surface of the developing sleeve shown in FIG. 3.

FIGS. 4 and 5 show the construction of the magnetic roller 7 of the modification. As shown in detail in FIG. 4, the magnetic roller 7 is fixedly provided within the developing sleeve 6 and has poles N1 to N4 and S1 to S5 arranged along its outer periphery. These poles include auxiliary poles S4 and S5 of the same polarity which are adjacent to each other circumferentially of the roller 7. The auxiliary poles are formed in the rear side portion of the roller 7 away from the drum 1 and opposed to an intermediate portion of a path through which the developer is transported upward from below.

In magnetic intensity, the pole S2 is 950 G, the poles S1, S3 and N1 to N3 are 800 G, the pole N4 is 500 G, and the auxiliary poles S4, S5 are up to 50 G. The poles S4, S5 provide a repellent magnetic field X.

The developer is supplied to the developing sleeve 6 and delivered therefrom in the following manner.

The developer remaining on the surface of the sleeve 6 upon passage through the developing station A is transported to the rear side of the sleeve away from the drum 1 and removed from the surface of the sleeve 6 by the repellent magnetic field X at the location of the auxiliary poles S4, S5, whereupon the developer collides with a portion of developer forwarded by the buckets 16 of the bucket roller 11 and is thereby forced toward the bucket roller 11.

Although the developer removed from the sleeve surface is subjected to an upward transport force due to the friction between the developer particles and the minute indentations in the surface, the transport force F exerted on the developer by the rotation of the sleeve 6 is caused to act toward the bucket roller 11 as seen in FIG. 5 by the presence of the auxiliary poles S4, S5 below a horizontal plane H through the center of the sleeve 6. Consequently, the developer removed from the sleeve surface is driven toward the bucket roller 11 by the transport force F and then falls due to gravity. Thus, the developer will not be retained on the surface of the developing sleeve 6.

In this way, the developer having its toner content reduced by development is removed from the sleeve 6 and replaced by a fresh portion of developer having an increased toner concentration and supplied to the sleeve. The developer can therefore be fed to the developing station A with a constant toner concentration at all times.

While the auxiliary poles S4, S5 of the above modification are adapted to have a magnetic force of up to 50 G, experiments have revealed that the developer can be replaced completely especially when the region of magnetization of the auxiliary poles S4, S5 is in the angular range of from 5 deg to 40 deg below the horizontal plane H at the center of the sleeve 6, with the magnetic force set to about 30 G.

In connection with the above modification, the developer is replaceable more effectively by providing a developer restraining plate between the developing sleeve 6 and the agitating roller 11, as opposed to the auxiliary poles and held out of contact with the sleeve 6.

Figure 7:
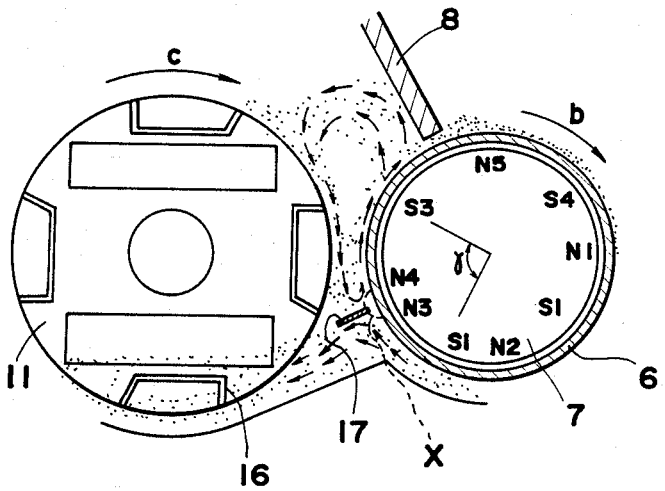
FIG. 7 is a fragmentary sectional view of the embodiment of FIG. 6.
Figure 8:
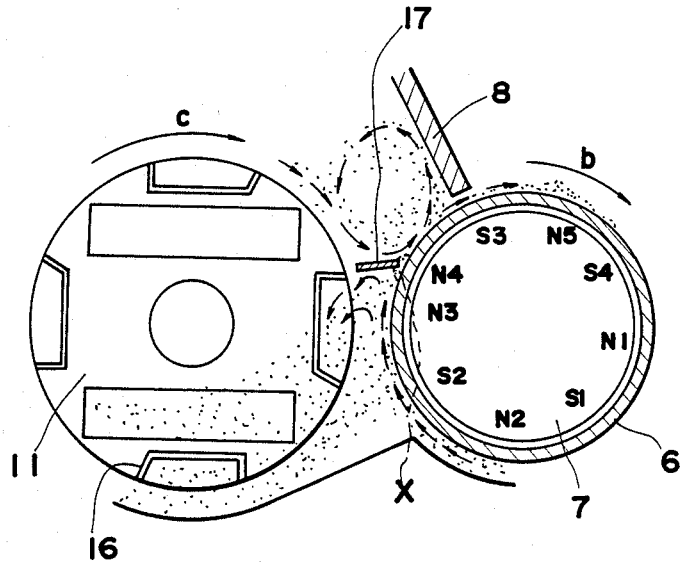
FIG. 8 is a fragmentary sectional view showing a modification of the embodiment of FIG. 6.

A second embodiment so designed will be described with reference to FIGS. 6 to 8.

Figure 6:
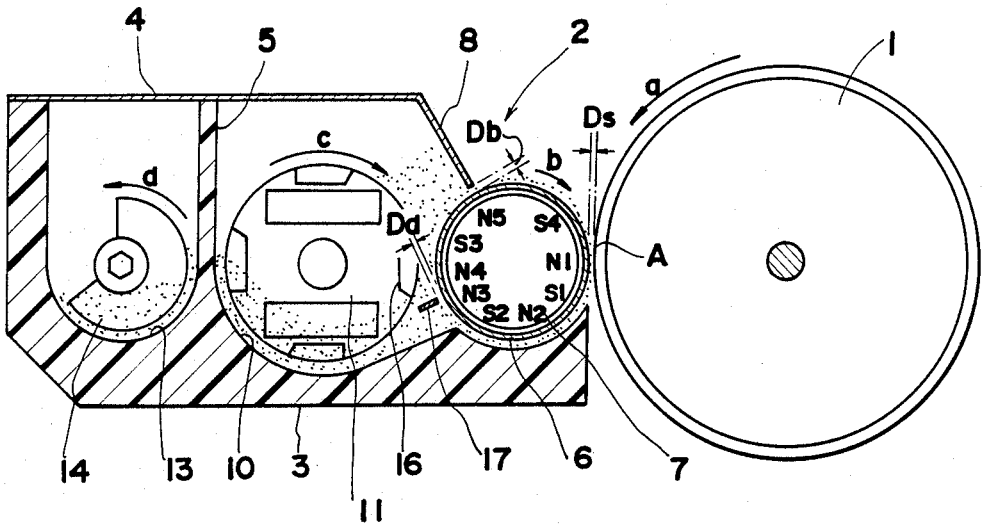
FIG. 6 is a sectional view showing another embodiment of the invention.

FIG. 6 is a sectional view showing the second embodiment which is generally similar to the one shown in FIG. 1 in construction. The agitating roller 11 shown is a bucket roller. A partition plate 16 extending toward the agitating roller 11 and spaced from the developing sleeve 6 by a specified gap Dd is provided in the vicinity of the auxiliary poles N3, N4.

In the developing apparatus 2 of the above construction, the developer is supplied to the developing sleeve 6 and released therefrom in the manner to be described below with reference to FIG. 7.

The developer remaining on the sleeve surface and having its toner content reduced by passing through the developing station A is transported upward from below on the rear side of the sleeve 6 opposite to the station A and removed from the sleeve surface by the repellent magnetic field X set up by the auxiliary poles N3 and N4.

The developer removed from the developing sleeve 6 is restrained from moving upward by the partition plate 17, whereby the developer is forced toward the agitating roller 11 and mixed by the roller 11 with the developer within the agitation channel 10 without being fed to the sleeve surface again.

On the other hand, the developer forwarded by the buckets 16 of the agitating roller 11 is restrained from moving toward the partition plate 17, flows reversely in the direction of transport along the sleeve 6 and is partially transported as supported on the sleeve surface in the direction of rotation (arrow b) of the sleeve 6 for use in development. The remaining portion of the developer not supported by the sleeve 6 turns about in the rear of the bristle height restricting plate 8 and flows back toward the agitating roller 11.

Thus, the partition plate 17 has a first guide surface or first guide means for guiding the developer supplied by the agitating roller 11. Also, the partition plate 16 has a second guide surface or second guide means for preventing the developer used for development from moving toward the sleeve portion to which the developer is supplied by the agitating roller 11.

Experiments conducted revealed the following.

(1) IF the gap Dd between the partition plate 17 and the developing sleeve 6 is large, the developer repellently removed from the sleeve surface and having a reduced toner content passes through the gap Dd and is retained again on the sleeve surface at a location downstream from the auxiliary poles N3, N4.

(2) When the magnetic force of the auxiliary poles N3, N4 is excessively great, the phenomenon (1) similarly occurs, so that the gap Dd needs to be decreased. Conversely, the magnetic force must be diminished when the gap Dd is to be enlarged.

Based on the above findings, an experiment was conducted under the following conditions, with the result that the developer on the sleeve 6 was completely removable to produce satisfactory copy images free of irregularities or reduction in density.

[Experimental conditions]

(i) Photosensitive drum
Outside diameter: 50 mm
Peripheral speed: 70 mm/sec
(ii) Developing sleeve
Outside diameter: 24.5 mm
Minute indentations: 5–10 μm
Peripheral speed: 141 mm/sec
Number of revolutions: 110 r.p.m.
(iii) Developing gap Ds: 0.45 mm
(iv) Bristle height restricting gap Db: 0.4 mm
(v) Gap Dd between partition plate and sleeve: 0.5 mm
(vi) Agitating roller (bucket roller)
Outside diameter of bucket assembly: 30 mm
Peripheral speed: 141 mm/sec
Number of revolutions: 90 r.p.m.
(vii) Magnetic roller
Magnetic force of developing pole N1: 900 G
Magnetic force of poles N2, N5, S1–S4: 600 G
Magnetic force of auxiliary poles N3, N4: up to 150 G
Angle $\gamma$ between poles S2, S3: 90 deg
(viii) Particle size of carrier: 60 μm (ferrite-binder type)
(ix) Particle size of toner: 12 μm Although the partition plate 17 of the above embodiment is disposed between the developing sleeve 6 and the agitating roller 11 below the position where these members are most proximate to each other, this arrangement is not limiting; the plate 17 may alternatively be located above the position.

While the developing sleeve and the agitating roller are so arranged that their centers of rotation are positioned approximately in the same horizontal plane according to the embodiment wherein the partition plate is provided as opposed to the auxiliary poles, this arrangement is not limiting. For example, the agitating roller may be disposed below the developing sleeve insofar as the partition plate is provided.

Further according to the embodiment wherein the partition plate is provided, the magnetic force of the auxiliary poles N3, N4 is up to 150 G, but the force may be set to a slightly higher level, e.g. up to 200 G, because of the presence of the partition plate.

As will be apparent from the first embodiment, the modification thereof and the second embodiment, the auxiliary poles may be N poles or S poles. The agitating roller may be a screw roller or bucket roller.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrostatic latent image developing apparatus comprising:

a developing sleeve drivingly rotatable for supplying a developer to the surface of an electrostatic latent image bearing member;

an agitating roller for supplying the developer to the developing sleeve while mixing and agitating the developer, the agitating roller being rotatable in the same direction as the developing sleeve to move in a direction opposite to the movement of the sleeve at the portion thereof adjacent to the sleeve, the center of rotation of the agitating roller being positioned approximately on the same horizontal plane as the center of rotation of the sleeve; and magnetic means fixedly provided within the developing sleeve and having a plurality of N and S poles extending axially of the sleeve, one of said N and S poles including auxiliary poles of the same polarity adjacent to each other circumferentially of the sleeve and opposed to the agitating roller in the vicinity of the horizontal plane through the center of rotation of the sleeve, the auxiliary poles being disposed at the upstream side of the sleeve portion to which the developer is supplied by the agitating roller and being magnetized to a lesser extent than the other poles such than at least a portion of the used developer on the developing sleeve is repelled from the developing sleeve as a result of the auxiliary poles and thereafter collides with at least a portion of the developer supplied by the agitating roller at a location adjacent said auxiliary poles.

2. An electrostatic latent image developing apparatus as claimed in claim 1 wherein said auxiliary poles are constituted of two magnetic poles.

3. An electrostatic latent image developing apparatus as claimed in claim 1 wherein the magnetic force of said auxiliary poles is preferably up to 150 G.

4. An electrostatic latent image developing apparatus as claimed in claim 3 wherein the magnetic force of said auxiliary poles is up to 50 G.

5. An electrostatic latent image developing apparatus as claimed in claim 3 wherein the angle between said auxiliary poles is preferably about 10 degrees.

6. An electrostatic latent image developing apparatus as claimed in claim 5 wherein the position of middle point of said auxiliary poles are preferably in the angular range of from 0 degrees to 5 degrees above a horizontal plane through the center of the sleeve.

7. An electrostatic latent image developing apparatus as claimed in claim 5 wherein the position of middle point of said auxiliary poles are preferably in the angular range of from 5 degrees to 40 degrees below a horizontal plane through the center of the sleeve.

8. An electrostatic latent image developing apparatus comprising:

a developing sleeve drivingly rotatable for supplying a developer to the surface of an electrostatic latent image bearing member;

an agitating roller for supplying the developer to the developing sleeve while mixing and agitating the developer, the agitating roller being rotatable in the same direction and being laterally adjacent to the sleeve; and magnetic means fixedly provided within the developing sleeve and having a plurality of N and S poles extending axially of the sleeve, one of said N and S poles including auxiliary poles of the same polarity adjacent to each other circumferentially of the sleeve and opposed to the agitating roller, the auxiliary poles being disposed at the upstream side of the sleeve portion to which the developer is supplied by the agitating roller, and being magnetized to a lesser extent than the other poles such that at least a portion of the used developer on the developing sleeve is repelled from the developing sleeve as a result of the auxiliary poles and thereafter collides with at least a portion of the developer supplied by the agitating roller at a location adjacent said auxiliary poles.

9. An electrostatic latent image developing apparatus comprising:

a developing sleeve drivingly rotatable for supplying a developer to the surface of an electrostatic latent image bearing member;

an agitating roller for supplying the developer to the developing sleeve while mixing and agitating the developer, the agitating roller being rotatable in the same direction as the developing sleeve to move in a direction opposite to the movement of the sleeve at the portion thereof adjacent to the sleeve;

magnetic means fixedly provided within the developing sleeve and having a plurality of N and S poles extending axially of the sleeve, one of said N and S poles including auxiliary poles of the same polarity adjacent to each other circumferentially of the sleeve and opposed to the agitating roller, the auxiliary poles being disposed at the upstresam side of the sleeve portion to which the developer is supplied by the agitating roller; and a developer restraining plate provided between the developing sleeve and the agitating roller in a position adjacent to the auxiliary poles and held out of contact with the sleeve, said developer restraining plate having a first guide surface and a second guide surface, said first guide surface in combination with the position of said developer restraining plate serving to guide the developer supplied by the agitating roller and said second guide surface in combination with the position of said developer restraining plate serving to prevent the developer used for development from moving toward the sleeve portion to which the developer is supplied by the agitating roller.

10. In a developing apparatus of the type including a developing sleeve and an adjacent agitating roller, the improvement comprising:

said sleeve being drivingly rotatable and supplying a developer to the surface of an electrostatic latent image bearing member;

said roller supplying the developer to the sleeve and mixing and agitating the developer and being rotatable in the same direction as said sleeve;

magnetic means fixedly provided within the sleeve and having a plurality of N and S poles extending axially of said sleeve, one of said N and S poles including auxiliary poles of the same polarity adjacent to each other circumferentially of said sleeve and opposed to said roller, said auxiliary poles being disposed at an upstream side of a portion of said sleeve to which said developer is supplied by said roller and being magnetized to a lesser extent than said other poles; and a developer restraining plate provided between said sleeve and said roller in a position adjacent to said auxiliary poles and held out of contact with said sleeve, said plate having a first guide means and a second guide means, said first guide means in combination with the position of said plate serving to guide the developer supplied by said roller and said second guide means in combination with the position of said plate serving to limit used developer from moving toward the sleeve portion to which the developer is supplied by said roller.

* * * * *

UNITED STATES PATENT AND TRADEMARK OFFICE

CERTIFICATE OF CORRECTION

PATENT NO. : 4,814,820

DATED : March 21, 1989

INVENTOR(S) : Hirahara et al

It is certified that error appears in the above-identified patent and that said Letters Patent is hereby corrected as shown below:

In the cover sheet under "Related U.S. Application Data", the phrase "Continuation of Ser. No. 875,671, Jun. 18, 1961, abandoned" should be corrected to read --Continuation of Ser. No. 875,671, Jun. 18, 1986, abandoned.--

Column 9, line 48, "than" should read --that--.

Signed and Sealed this

Third Day of October, 1989

*Attest:*

*Attesting Officer*

DONALD J. QUIGG

*Commissioner of Patents and Trademarks*